US009412272B2

(12) United States Patent
Lee

(10) Patent No.: US 9,412,272 B2
(45) Date of Patent: Aug. 9, 2016

(54) APPARATUS AND METHOD FOR CONTROLLING TRAFFIC SIGNALS

(75) Inventor: Heung Soo Lee, Seoul (KR)

(73) Assignee: Heung Soo Lee, Seoul (KR)

( * ) Notice: Subject to any disclaimer, the term of this patent is extended or adjusted under 35 U.S.C. 154(b) by 136 days.

(21) Appl. No.: 14/232,535

(22) PCT Filed: Jun. 21, 2012

(86) PCT No.: PCT/KR2012/004908

§ 371 (c)(1),
(2), (4) Date: Jan. 13, 2014

(87) PCT Pub. No.: WO2013/012177

PCT Pub. Date: Jan. 24, 2013

(65) Prior Publication Data

US 2014/0159924 A1 Jun. 12, 2014

(30) Foreign Application Priority Data

Jul. 18, 2011 (KR) ..... 10-2011-0070765

(51) Int. Cl.

| | |
|---|---|
| ***G08G 1/095*** | (2006.01) |
| ***G08G 1/07*** | (2006.01) |
| ***G08G 1/082*** | (2006.01) |
| ***G08G 1/081*** | (2006.01) |

(52) U.S. Cl.

CPC ..... *G08G 1/07* (2013.01); *G08G 1/081* (2013.01); *G08G 1/082* (2013.01); *G08G 1/095* (2013.01)

(58) Field of Classification Search

CPC ..... G08G 1/07; G08G 1/0137; G08G 1/0112; G08G 1/0145; G08G 1/08; G08G 1/081; G08G 1/082; G08G 1/095

USPC ..... 340/907, 915, 990, 995.13, 905, 911, 340/913, 916; 701/117

See application file for complete search history.

(56) References Cited

U.S. PATENT DOCUMENTS

| | | | | |
|---|---|---|---|---|
| 5,257,194 A * | 10/1993 | Sakita | ..... | G08G 1/081 340/911 |
| 5,673,039 A * | 9/1997 | Pietzsch | ..... | G08G 1/015 340/332 |
| 8,050,854 B1 * | 11/2011 | Chandra | ..... | G08G 1/081 340/917 |

(Continued)

FOREIGN PATENT DOCUMENTS

| | | |
|---|---|---|
| CN | 101256718 | 9/2008 |
| KR | 1020010100275 | 11/2001 |

(Continued)

*Primary Examiner* — Anh V La
(74) *Attorney, Agent, or Firm* — IP & T Group LLP

(57) ABSTRACT

Device and method of controlling a traffic light on the basis of an analysis result of a broadcast signal transmitted via a broadcast network are provided. The traffic light control device controlling signal light change of a traffic light, includes: a broadcast signal receiving unit that receives a broadcast signal emitted from a traffic control center via a broadcast network; and a traffic light control unit that determines an offset time from a reference traffic light on the basis of an analysis result of the broadcast signal and that outputs a control signal for controlling the light change of a control target traffic light so that a time point which lags by the determined offset time from a signal light display start time point of the reference traffic light is matched with a signal light display start time point of the control target traffic light.

16 Claims, 6 Drawing Sheets

(56) References Cited

U.S. PATENT DOCUMENTS

| | | | | |
|---|---|---|---|---|
| 8,855,900 | B2 * | 10/2014 | Lection | G08G 1/0145 340/907 |
| 2010/0164753 | A1 * | 7/2010 | Free | G08G 1/096783 340/932 |

FOREIGN PATENT DOCUMENTS

| | | |
|---|---|---|
| KR | 100446677 | 9/2004 |
| KR | 1020060129993 | 12/2006 |
| KR | 1020090008964 | 1/2009 |
| KR | 101043912 | 6/2011 |

* cited by examiner

FIG. 3b

| 330 DISTINCTION DATA | 332 START TIME | 334 CONTROLLER ID | 336 TRAFFIC LIGHT NUMBER | 338 SIGNAL LIGHT ORDER | 340 FIRST SIGNAL LIGHT CYCLE | SECOND SIGNAL LIGHT CYCLE | ... |
|---|---|---|---|---|---|---|---|
| | | | TRAFFIC LIGHT NUMBER | SIGNAL LIGHT ORDER | FIRST SIGNAL LIGHT CYCLE | SECOND SIGNAL LIGHT CYCLE | ... |
| | | | TRAFFIC LIGHT NUMBER | SIGNAL LIGHT ORDER | FIRST SIGNAL LIGHT CYCLE | SECOND SIGNAL LIGHT CYCLE | ... |
| | | CONTROLLER ID | TRAFFIC LIGHT NUMBER | SIGNAL LIGHT ORDER | FIRST SIGNAL LIGHT CYCLE | SECOND SIGNAL LIGHT CYCLE | ... |
| | | ... | ... | ... | ... | ... | ... |

APPARATUS AND METHOD FOR CONTROLLING TRAFFIC SIGNALS

This application is a national stage application of PCT/KR2012/004908 filed on Jun. 21, 2012, which claims priority of Korean patent application number 10-2011-0070765 filed on Jul. 18, 2011. The disclosure of each of the foregoing applications is incorporated herein by reference in its entirety.

TECHNICAL FIELD

The present invention relates to traffic light control device and method, and more particularly, to device and method of controlling a traffic light on the basis of an analysis result of a broadcast signal transmitted via a broadcast network.

BACKGROUND ART

Traffic lights are devices which are installed at crossroads or crosswalks on roads and which indicate stop, detour, traveling, and the like to passing vehicles or pedestrians by flickering of red light, green light, yellow light, green arrow light, and the like.

With an exponential increase of vehicles, traffic congestion has become serious problems. The vehicle stop time due to traffic lights at downtown crossroads or crosswalks occupies a considerable ratio of the congestion rate due to various factors of roads. Therefore, it has been thought that the traffic congestion could be released by controlling signal light cycles of traffic lights at crossroads or crosswalks so as to improve traveling of vehicles, and various countermeasures have been proposed for this purpose.

Traffic light controllers are connected to a traffic control center via a network and changes signal light in accordance with a control signal output from the traffic control center to adjust a flow of vehicles. In the related art, the traffic tight controllers and the traffic control center are connected to each other via a wired network using exclusive lines. Since the traffic control center and the traffic light controllers communicate with each other in a one-to-one manner, the traffic control center needs a complicated system to transmit different control commands to all the traffic light, controllers. In addition, since the traffic control center has to finish communications with all the traffic light controllers within a predetermined time, the system or the wired network, using exclusive lines should be kept at a high speed and thus much cost such as facility cost, communication cost facility maintenance cost, and network maintenance cost, is consumed.

Therefore, in general only the traffic light controllers controlling traffic lights installed in important road zones such as crossroads are connected to the traffic control center, in this case, in the traffic light controllers installed out of the important road zones such as crossroads, the cycle of a signal light changing operation is set to be constant and the signal light is changed with a predetermined cycle to adjust, a flow of vehicles. That is, the traffic light controllers other than the traffic light controllers connected to the traffic control center operate without any interlock with rite control of the traffic control center.

As described above, since only the traffic light controllers connected to the traffic control center via exclusive lines perform a signal light changing operation on traffic lights on the basis of traffic information based on traffic conditions to control a flow of vehicles and the other traffic light controllers perform the signal light, changing operation with a predetermined signal light change cycle, there is a problem in that signal light of all the traffic lights cannot be controlled as a whole and thus a flow of vehicles cannot be smoothly controlled.

As a solution to this problem, Korean Patent Application Publication No, 10-2001-0100275 filed by the applicant of the present invention discloses traffic light control device and method of controlling a signal light changing operation by causing a traffic control center to selectively output a control signal for controlling traffic light controllers in a wireless manner. The applicant of the present invention has filed a lot of patent applications such as Korean Patent Application Publication No. 10-2006-0129993. However, in this case, different controls signals have to be generated and output to control a lot of traffic light controllers.

In the related art, Korean Patent Application Publication No. 10-2009-0008964 discloses a traffic light control device for smoothing a traffic flow in consideration of the number of vehicles by periodically counting passing vehicles, increasing a lighting time of a blue light when the number of vehicles increases, and decreasing the lighting time of a blue light when the number of vehicles decreases. In this case, a sensor unit for detecting a toweling vehicle and a counter unit for counting the number of vehicles need to be provided to each traffic light control device and the traffic lights are controlled independently of the control of the traffic control center. Accordingly, there is a problem in that the traffic lights may operate regardless of traffic flows of other roads.

SUMMARY OF THE INVENTION

Technical Problem

An object of the present, invention is to provide traffic light control device and method which can cause plural traffic light controllers, which have a correlation and are grouped into a single group, to change traffic signal light, on the basis of a vehicle traveling speed so that the traffic signal light with the same change cycle leads or lags by a predetermined offset with respect to a reference traffic light when a traffic control center broadcasts a command via a broadcast network.

Another object of the present invention is to provide traffic light control device and method which can considerably reduce an amount of data to be transmitted by enabling a command to be transmitted to plural traffic light controllers with one broadcasting via a broadcast network which can transmit a command to plural traffic light controllers by simultaneously transmitting the command to the plural traffic light controllers, and which does not need to be connected to a traffic control center in a one-to-one manner.

Other features of the present invention will be apparently understood from the following description.

Solution to Problem

According to an aspect of the present invention, there is provided a traffic light control device that controls signal light change of a traffic light, including: a broadcast signal receiving unit that receives a broadcast signal emitted from a traffic control center via a broadcast network; and a traffic light control unit that determines an offset time from a reference traffic light on the basis of an analysis result of the broadcast signal and that outputs a control signal for controlling the light change of a control target traffic light so that a time point which lags by the determined offset time from a signal light display start time point of the reference traffic light is matched with a signal light display start time point of the control target traffic light.

The traffic light control unit may include: a broadcast signal analyzing unit that analyzes the broadcast signal; a time synchronization unit that synchronizes a system time of the control target traffic light with a system time of the reference traffic light using time-synchronization rime data extracted from the broadcast signal or a GPS time estimated through the use of a GPS unit; an offset setting unit that sets the offset time using an offset parameter extracted from the broadcast signal; and a signal light change control unit that outputs a control signal for starting signal light display of the control target traffic light at a time point which lags by the offset time from the signal light display start time point of the reference traffic light.

The offset parameter may be a traveling speed of vehicles in a road in which the control target traffic light is installed, and tire offset setting unit may set the offset time on the basis of a correlation with a distance between the reference traffic light and the control target traffic light.

Alternatively, the control target traffic light along with other control target traffic lights installed in a road having the control target traffic light installed therein may be grouped into a reference traffic light sharing group, the control target traffic lights may share one of traffic lights really installed at any position of the road or virtually installed as the reference traffic light, the offset, parameter may be data in which offset, times of all the control target traffic lights belonging to the reference traffic light sharing group are arranged in a predetermined order, and the offset setting unit may extract the offset times of the order corresponding to the control target traffic lights and may set the extracted offset rimes as the offset times of the corresponding control target traffic lights.

The offset time may be determined on the basis of a correlation between a distance between the reference traffic light and the control target traffic light and a traveling speed of a vehicle in a road in which the control target traffic light is installed.

One or mom of the distance and the traveling speed may be a value in which road information including one or more of the number of lanes, gradient, curvature, presence of a speed bump, a state of a road surface, weather, vehicle traffic, queue, and time zone is reflected.

The broadcast signal may be broadcast from the traffic control center via one of an FM broadcast channel, an AM broadcast, channel, and a DMB broadcast channel. The broadcast signal may be broadcast by base stations by CDMA or WIFI.

The signal light display start time point may be a time point at which tire reference traffic light and the control target traffic light start mainly displaying signal light indicating traveling of vehicles.

According to another aspect of the present invention, there are provided a traffic light control method which is performed by a traffic light control device that controls light change of a traffic light, and a recording medium having thereon a program for performing the traffic light control method.

The traffic light control method may include the steps of: receiving unit a broadcast signal emitted from a traffic control center via a broadcast network; analyzing the broadcast signal; determining an offset lime from a reference traffic light on the basis of an analysis result of the broadcast signal; and outputting a control signal for controlling the light change of a control target traffic light so that a time point which lags by the determined offset time from a signal light display start time point of the reference traffic light is matched with a signal light display start time point of the control target traffic light.

A step of synchronizing a system, time of the control target traffic light with a system time of the reference traffic light using time-synchronization time data extracted from the broadcast signal or a GPS time estimated through the use of a GPS unit may be performed before the step of determining the offset time.

The step of determining the offset time may include setting the offset time using an offset parameter extracted from the broadcast signal, the offset parameter may be a traveling speed of a vehicle in a road in which the control target traffic light is installed, and the offset time may be set on the basis of a correlation with a distance between the reference traffic light and the control target traffic light.

Alternatively, the step of determining the offset time may include setting the offset time using an offset parameter extracted from the broadcast signal, the control target traffic light along with other control target, traffic lights installed in a road having the control target traffic light installed therein may be grouped into a reference traffic light sharing group, the control target traffic lights may share one of traffic lights really installed at any position of the road or virtually installed as the reference traffic light, the offset parameter may be data in which offset times of all the control target traffic lights belonging to the reference traffic light sharing group are arranged, in a predetermined order, and the offset times of the order corresponding to the control target traffic lights may be extracted and are set as the extracted offset times as the offset times of the corresponding control target traffic lights.

Other aspects, features, and advantages of the present invention will become apparent from the accompanying drawings, the appended, claims, and the detailed description of the invention.

Advantageous Effects

According to the aspects of the present invention, it is possible to cause plural traffic light controller's, which have a correlation and are grouped into a single group, to change traffic signal light on the basis of a vehicle traveling speed so that the traffic signal light with the same change cycle leads or lags by a predetermined offset with respect to a reference traffic light when a traffic control center broadcasts a command via a broadcast network.

It is also possible to considerably reduce an amount of data to be transmitted by enabling a command to be transmitted to plural traffic light controllers with one broadcasting via a broadcast network which can transmit a command to plural traffic light controllers by simultaneously transmitting the command to the plural traffic light controllers, and which does not need to be connected to a traffic control center in a one-to-one manner.

BRIEF DESCRIPTION OF THE DRAWINGS

FIG. 3*b* is a diagram illustrating an example of a format, of signal change control information according to the present invention.

DESCRIPTION OF EMBODIMENTS

The invention can be modified in various forms and specific embodiments will be described and shown below. However, the embodiments are not intended to limit the invention, but it should be understood that the invention includes all the modifications, equivalents, and replacements belonging to the concept and the technical scope of the invention. When it is determined that detailed description of known techniques involved in the invention makes the gist of the invention obscure, the detailed description hereof will not be made.

Terms such as "first" and "second" can be used to describe various elements, but the elements are not limited to the terms. The terms are used only to distinguish one element from another element.

The terms used in the following description are intended to merely describe specific embodiments, but not intended to limit the invention. An expression of the singular number includes an expression of the plural number, so long as it is clearly read differently. The terms such as "include" and "have" are intended to indicate that features, numbers, steps, operations, elements, components, or combinations thereof used in the following description exist and it should thus be understood that the possibility of existence or addition of one or more other different features, numbers, steps, operations, elements, components, or combinations thereof is not excluded, to this specification, when it is mentioned that an element is "connected" to another element, it should be understood that, both elements are "indirectly connected" with still another element interposed therebetween, as well as that both elements are "directly connected".

When it is determined that detailed description of known techniques involved in the invention unnecessarily makes the gist, of the invention obscure, the detailed description thereof will not be made.

Hereinafter, embodiments of tire invention will be described in detail with reference to the accompanying drawings.

Figure 1:
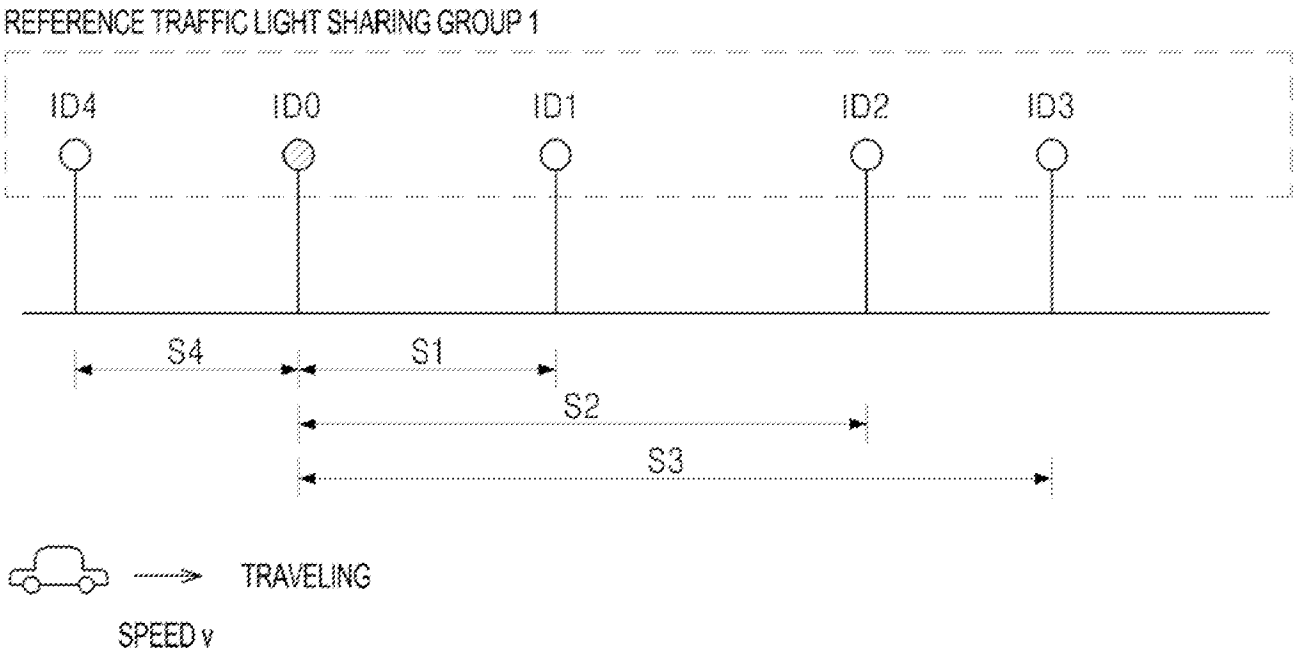
FIG. 1 is a diagram illustrating a concept of a traffic light control method according to an embodiment of the present invention.

FIG. 1 is a diagram illustrating the concept of a traffic light control method according to an embodiment of the invention. As illustrated in FIG. 1, it is assumed that traffic lights ID0 to ID4 are installed, at crossroads and/or crosswalks of a road with a constant gap or arbitrary gaps.

When the traffic lights ID0 to ID4 are sequentially changed to green light which indicates that vehicles can go ahead, that is, when a vehicle at a reference traffic light ID0 moves and a next traffic light operates to display signal, light indicating that vehicles can go ahead at the time of reaching the next traffic light, it will be possible to shorten the wait time at traffic lights of the crossroads or crosswalks, to improve a traffic flow; and to reduce traffic congestion.

For this purpose, traffic lights ID0 to ID4 which are installed in a road and which share a single reference traffic light are grouped into a reference traffic light sharing group 1. The traffic lights ID0 to ID4 belonging to the reference traffic light sharing group 1 share a traffic light as a reference traffic light and determine a signal light display start time point at which signal light change of the traffic lights is started by interlocking with the signal light display start time point of the reference traffic light. Here, the reference traffic light may be a traffic light which is really installed, but may be a virtual traffic light which is not really installed in some cases.

In the below description, it is assumed that the reference traffic light is ID0 and control target traffic lights are ID1 to ID4. When the reference traffic light ID0 is not a virtual traffic light, the reference traffic light ID0 may also be included in tire control target, traffic lights.

The control target, traffic lights are installed at crossroads or crosswalks and include traffic lights for vehicles and traffic lights for pedestrians of which the signal light change is carried out by interlocking with each other. For example, in case of a crossroad, four-direction traffic lights installed at the crossroad aid four pairs of traffic lights for pedestrians used to cross the roads are included in the control target traffic lights, in case of a crosswalk, a bidirectional traffic light and a pair of traffic lights for pedestrians are included in the control target traffic lights.

By setting the signal light display start time point, of the reference traffic light ID0 as a reference start time and causing the signal light display start time points of the control target traffic lights ID1 to ID4 to lead or lag with respect to the reference start time by offset times derived from the correlation between the distance between the reference traffic light ID0 and the control target traffic lights ID1 to ID4 and the traveling speed of vehicles, the corresponding control target traffic light is changed to green light at the time point at which a vehicle passing through the reference traffic light ID0 reaches the corresponding control target traffic light, and thus the vehicle can continue to go ahead without stopping.

When it is assumed that the signal light display start time point of the reference traffic light ID0 is 00:00, the offset time of the first control target traffic light ID1 is derived as S1/v on the basis of the correlation between the traveling speed v of a vehicle and the distance from the reference traffic light ID0 and the signal light display start rime point thereof is set to the time point which lags by S1/v from 00:00. The offset times of the second and third control target traffic lights ID2 and ID3 are derived as S2/v and S3/v on the basis of the correlation between the traveling speed v of a vehicle and the distances S2 and S3 from the reference traffic light ID0 and the signal light display start time points thereof are set to the time points which lag by S2/v and S3/v from 00:00. Regarding the fourth control target traffic light ID4, since the distance from the reference traffic light ID0 is S4 but the position thereof is located in the direction opposite to the traveling direction of the vehicle, the offset time is derived as −S4/v and the signal light display start time point of the fourth control target traffic light ID4 is set to the time point which leads by S4/v from 00:00.

Here, the traveling speed v of a vehicle is not a speed at which the vehicle actually travels, but is a signal light-interlocked speed interlocking with the signal light change of traffic lights so as to make a traffic flow smooth and may have a value in which actually-collected road information such as the number of lanes, gradient, curvature, presence of a speed bump, a state of a road surface, weather, vehicle traffic, queue, and rime zone is reflected. The signal light-interlocked speed is different from the concept of section speed information in TPEG.

The traveling speed of a vehicle is a representative speed (for example, the highest movement speed or the speed with a long movement time) in the corresponding road and the difference from the actual speed can be adjusted using a pseudo-distance (phase distance). Here, the pseudo-distance (phase distance) is not an actual distance and the magnitude may be different from the actual distance depending on the road conditions or the like.

For example, in rainy weather, the traveling speed of a vehicle is set to a speed reduced by 10% to 20% from the traveling speed in fine weather and can be used as a parameter for calculating an offset time for determining the signal light display start time points of the control target traffic lights. In addition, one or more of road information pieces actually collected can be used as a factor for determining the traveling speed. The determination method thereof can be implemented in the form of a linear function, a quadratic function, or a multi-order function with multiple unknowns. Such a method of determining the traveling speed can be determined using statistical results by experiments or measurements, which is obvious to those skilled in the art and thus will not be described in detail.

The above-mentioned road information may be reflected in the distance between the traffic lights instead of the traveling speed. This distance may be referred to as a phase distance. Here, the offset time can be calculated as expressed by Expression 1.

$$\text{Offset time} = \text{phase distance}/\text{speed} + \text{deviation} \qquad \text{Expression 1}$$

When a factor independently operating is present in the factors reflected in the phase distance, the expression for calculating the offset time may be expressed by an expression with multiple unknowns or a polynomial expression with multiple unknowns.

A system, a device, and a method enabling the above-mentioned traffic light control will be described below with reference to the accompanying drawings.

Figure 2:
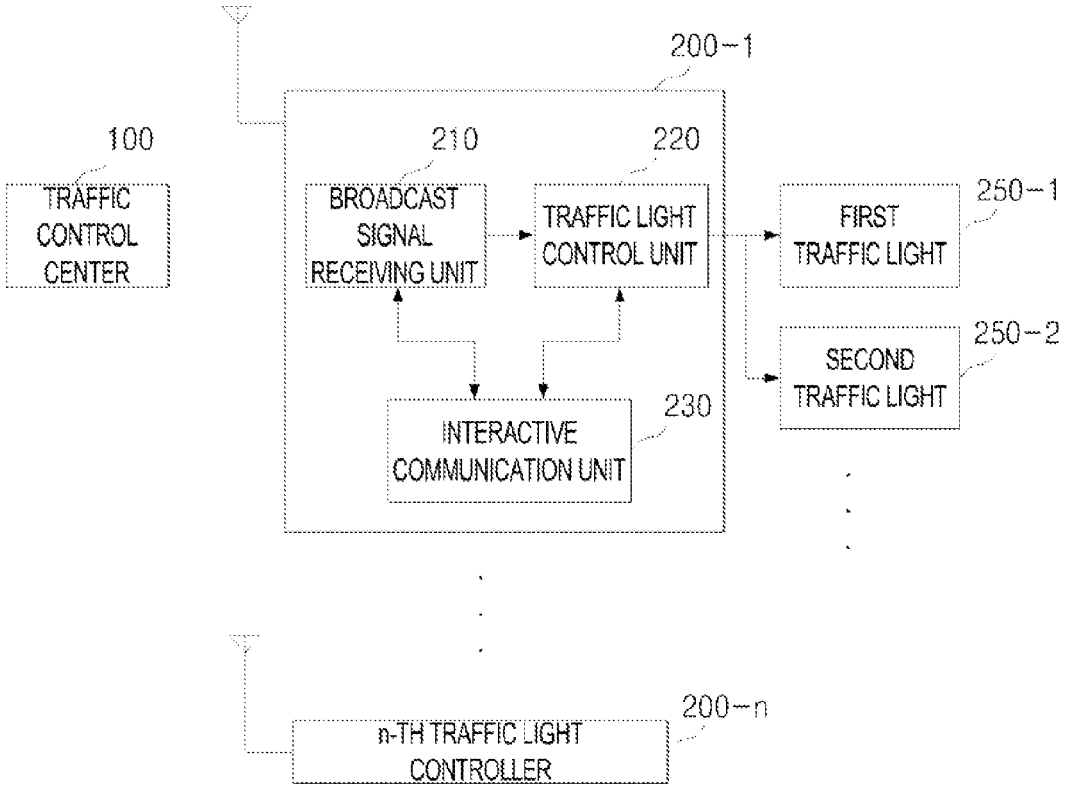
FIG. 2 is a block diagram illustrating a configuration of a traffic signal control system according to an embodiment of the present invention.
Figure 3A:
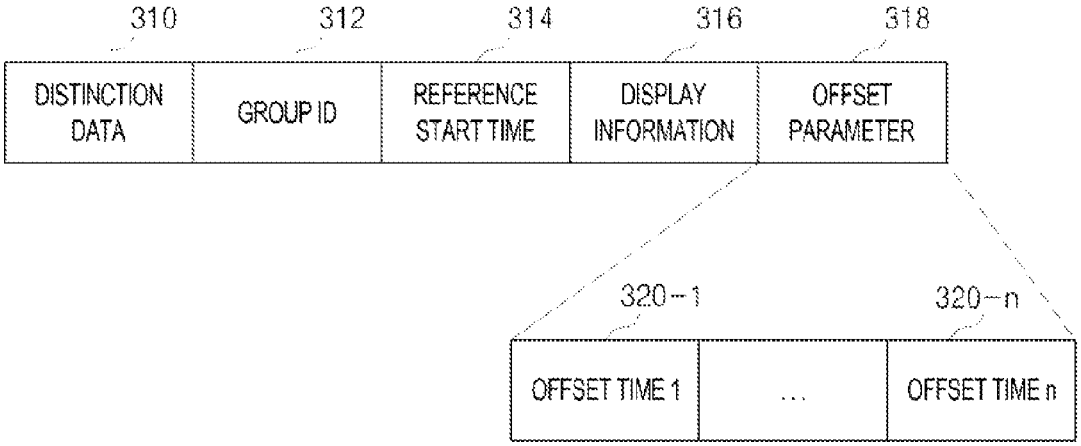
FIG. 3*a* is a diagram illustrating an example of a format of display start control information according to the present, invention.
Figure 3C:
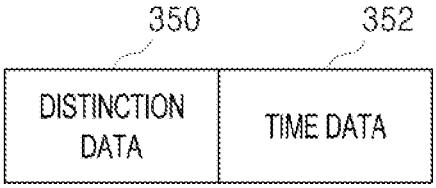
FIG. 3*c* is a diagram illustrating an example of a format of time synchronization information according to the present invention.
Figure 4:
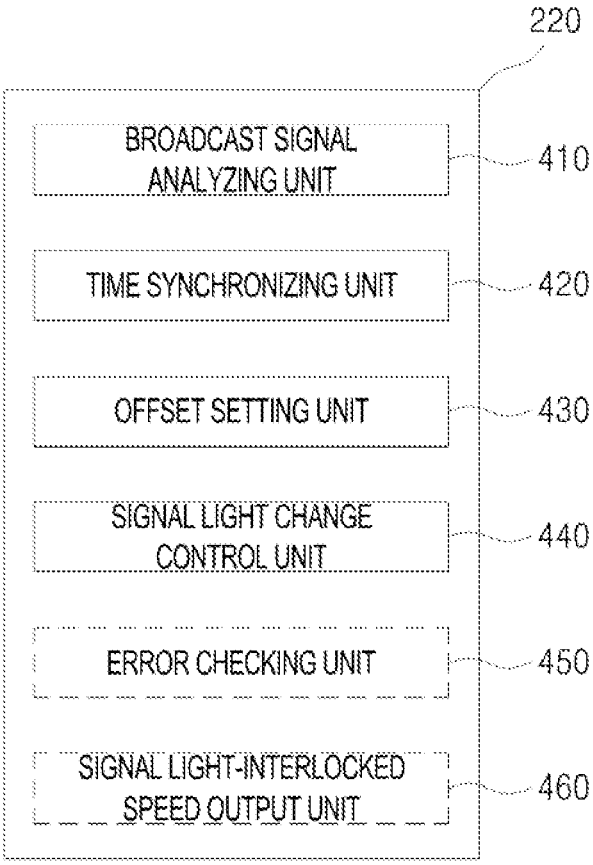
FIG. 4 is a block diagram illustrating a configuration of a traffic light control unit according to an embodiment of the present invention.

FIG. 2 is a block diagram illustrating a configuration of a traffic signal control system according to an embodiment of the present invention. FIG. 3*a* is a diagram illustrating an example of a format of display start, control information according to the present invention. FIG. 3*b* is a diagram illustrating an example of a format of signal change control information according to the present invention, FIG. 3*c* is a diagram illustrating an example of a format of time synchronization information according to tire present invention. FIG. 4 is a block diagram illustrating a configuration of a traffic light control unit according to an embodiment of the present invention.

Referring to FIG. 2, a traffic light control system according to an embodiment of the invention includes a traffic control center 100 aid first to n-th traffic light controllers 200-1 to 200-*n* (which are generically referred to as 200). One traffic light controller is connected to one or more traffic lights 250-1, 250-2, . . . and signal light change of the one or more traffic lights 250-1, 250-2, . . . is controlled by the corresponding traffic light controller. Here, each of the traffic lights 250-1, 250-2, . . . may be one of traffic lights for vehicles or pedestrians installed, at crossroads or crosswalks. In the below description, the one or more traffic lights 250-1, 250-2, . . . are assumed to be one control target traffic light.

In the traffic light control system according to the embodiment of the invention, when the traffic control center 100 broadcasts a broadcast signal including display start control information for causing relevant traffic lights (control target traffic lights belonging to a reference traffic light sharing group, which are installed in the road) to sequentially start displaying of predetermined signal light on the basis of currently-collected road information, the traffic light controllers receive and analyze the broadcast signal, determine signal light display start rime points suitable for the traffic lights to be controlled, and control signal fight change of the corresponding traffic lights in synchronization with the signal light display start time points. The signal change with the same display cycle in the relevant traffic lights lags or leads by a predetermined offset time with respect to the reference traffic light by one command (broadcast) and the traffic lights on the road sequentially change the traffic signal light by interlocking with the traveling speed of a vehicle, thereby making a traffic flow smooth and releasing traffic congestion.

The traffic control center 100 collects road information for controlling the signal light display start time point of the traffic lights. The collected road information is loaded into a broadcast signal without any change or with being processed or the offset times by traffic lights calculated on the basis of the collected road information are loaded into a broadcast signal, and the broadcast signal is broadcast via a broadcast network.

Such a broadcast signal is sent out at a time from the traffic control center 100 by data communication such as frequency modulation (FM) or amplitude modulation (AM) or data and command word communication such as digital multimedia broadcasting (DMB). Alternatively the broadcast signal may be sent, out at a time from a base station, which is (not illustrated) connected to the traffic control center 100 via a wired or wireless network, via a mobile communication network such as CDMA, WCDMA, GSM, and LIE or a short-range radio communication network such as WIFI. That is, the broadcast signal may be sent out by base stations.

The broadcast signal sent out from the traffic control center 100 has a format illustrated in FIGS. 3*a* to 3*c*. The broadcast signal is configured to include display start control information (see FIG. 3*a*) for controlling the signal light display start time point of the first, to n-th traffic light controllers 200 aid signal light change control information (see FIG. 3*b*) for controlling signal light change cycles of the first to n-th traffic light controllers 200. In some embodiments, the broadcast signal may further include time synchronization information (see FIG. 3*c*) for synchronizing times of the first to n-th traffic light controllers 200.

That is, as illustrated in FIG. 3*a*, the display start control information includes distinction data 310 for distinguishing information for controlling the display start rime point or information for controlling signal light, a group identifier 312 including an ID for identifying the reference traffic light sharing group of which the current display start time point should be adjusted, reference start time data 314 indicating a rime point at which signal light display of the reference traffic light is started, display information 316 indicating a signal light change order, signal light change cycles, and the like of the control target traffic lights, and an offset parameter for calculating the offset rimes of the control target traffic lights with respect to the reference traffic light. The offset parameter 318 may include a traveling speed for calculating the offset times on the basis of the currently-collected road information, or the offset times 320-1 to 320*n* of the control target, traffic lights belonging to the reference traffic light slurring group may be sequentially arranged in a predetermined order. The order in which the offset times of the control target traffic lights are arranged is defined in advance, and data on the order (that is, the order in which the offset times are arranged) of the control target traffic lights in tire reference traffic light sharing group may be stored in advance.

An ID of the road may be used as the group identifier 312. In this case, the ordinal number (order) added as an extension to the road ID can be used as a traffic light ID. For example, when the road ID is 100, the IDs of the traffic lights installed in the road may be 101, 102, 103, . . . or 1001, 1002, 1003, . . . . Here, the ordinal numbers may not be relevant to the actual positions, and for example, an installation order or a traveling order may be used.

As illustrated in FIG. 3*b*, the signal light change control information includes distinction data 330 for distinguishing information for controlling the display start time point or information for controlling signal light, start time data 332 including start time at which the signal light changing operation is performed, controller identifiers 334 including IDs for identifying the first to n-th traffic light controllers 200, traffic light number data 336 for distinguishing the traffic lights controlled by the first to n-th traffic light controller's 200, signal light order data 338 including a signal light change order of the traffic lights, and signal light cycle data 340 for holding the changed signal light.

The order in which signal light is changed by the signal light, order data 338 includes a variety of display such as (stop→pass→stop), (stop→pass→left turn→stop), and (stop→left turn→stop→pass→stop) and is repeated with a constant cycle in a ring structure.

In the present invention, the display appearing first in the signal light change cycle is referred to as main display, and it is assumed that the main display in all the traffic lights means pass of vehicles. That is, the main display in each control target traffic light appearing under the signal light change control just after the display start time point is green light indicating pass of vehicles.

As illustrated in FIG. 3*c*, the time synchronization information includes distinction data 350 for distinguishing information for the time synchronization control and time data 352 which is information for synchronizing the times of the first to n-th traffic light controllers 200 to remove time errors among the first, to n-th traffic light controllers 200. Here, the time synchronization information is transmitted for each predetermined cycle to reset the timepieces installed in the first to n-th nitric light controllers 200, and the time data 352 provides a current time in the units of seconds in a range of 00000 to 86400 (=24 hours×60 minutes×60 seconds) in a day.

Tire timepieces of the first to n-th traffic light controllers 200 can be synchronized by the time synchronization information and the signal light changes of the traffic lights is controlled to interlock with each other under the same time reference.

When the first to n-th traffic light controllers 200 include a GPS unit (not illustrated), the timepieces of the traffic light controllers can be synchronized using GPS time data included in a GPS signal. In this case, the time synchronization information can be omitted from the broadcast signal. The timepiece synchronization using a GPS signal is obvious to those skilled in the art and thus detailed description thereof will not be made.

Referring to FIG. 2, the traffic control center 100 may receive state information of the controllers and the traffic lights transmitted from the traffic light controllers 200. The state information of the controllers and tire traffic lights may include information on abnormal states of the controllers, broadcast, signal reception error, traffic light operation error, and the like.

The first traffic light controller 200-1 includes a broadcast signal receiving unit 210 and a traffic light control unit 220. In some embodiments, the first traffic light, controller may further include a interactive communication unit 230. Tire other traffic light controllers have the same configuration as the first traffic light controller 200-1. The first traffic light controller 200-1 will be mainly described below.

The traffic light controllers 200 are installed to correspond to control target traffic lights (including a reference traffic light which is not virtual), respectively and manage the control target traffic lights. The traffic light controller 200 may be disposed in a housing installed on the outer wall of a traffic light or a separate housing disposed around the traffic light with devices or instruments corresponding to the constituent units mounted thereon.

In some embodiments, two or more traffic light controllers 200 may be provided to one control target traffic light. For example, in a crossroad, since four traffic lights for vehicles and four traffic lights for pedestrians should be controlled and tire positions of the traffic lights are physically spaced apart, plural traffic lights may be grouped into two or more groups and may be individually controlled by plural traffic light controllers 200, for the purpose of convenience of the signal light change control and facilitation of installation. In this case, two or more traffic light controllers 200 managing one control target traffic light may have the same identifier.

The broadcast signal receiving unit 210 receives the broadcast signal sent out from the traffic control center 100. The broadcast signal sent out from the traffic control center 100 is broadcast as a data broadcast signal such as FM, AM, or DMB via a predetermined broadcast channel, and the broadcast signal receiving unit 210 may be an FM receiver, an AM receiver, or a DMB receiver for receiving such data broadcast signal via tire corresponding broadcast channel.

The traffic light control unit 220 controls the signal light change of the control target traffic lights managed by the traffic light controller 200. Here, the control target traffic lights include traffic lights for vehicles and/or traffic lights for pedestrians which are installed at a crossroad or a crosswalk and of which the signal light change is performed by interlocking with each other.

In order to control the signal light change of the control target traffic lights, the traffic light control unit 220 analyzes the broadcast signal received by the broadcast signal receiving unit 210 and determines offset times with respect to a reference traffic light in the reference traffic light sharing group to which the control target traffic lights belong on the basis of the analysis result. The signal light display start time points of the control target traffic lights are determined so that the signal light display of the control target traffic lights is started at time points which lags by the determined, offset times from the reference start time which is the signal light display start time point of the reference traffic light, and a control signal for controlling the signal light change of the control target traffic lights is output. Here, when the offset time has a negative value, the time point which leads by the absolute value of the offset time is the signal light display start time point of me corresponding control target traffic light.

The traffic light control unit 220 will be described below in detail with reference to FIG. 4.

Referring to FIG. 4, the traffic light control unit 220 includes a broadcast signal analyzing unit 410, a time synchronization unit 420, an offset setting unit 430, and a signal light change control unit 440. In some embodiments, the traffic light control unit may further include an error checking unit 450 and/or a signal light-interlocked speed output unit 460. One or more elements of the traffic light control unit may be embodied in the form of one or more of an algorithm implemented by a combination of program codes and a software program.

The broadcast signal analyzing unit 410 analyzes the broadcast signal received by the broadcast signal receiving unit 210 and extracts an offset parameter suitable for the control target traffic light, signal light, control data, time data, and the like from the broadcast signal. The format of the broadcast signal is the same as described with reference to FIG. 3.

Before determining the offset time, the control target, traffic lights belonging to the reference traffic light sharing group need to have the same system time, and the traffic light control unit 220 includes the time synchronizing unit 420 to synchronize the system times.

When the traffic light controller 200 includes a GPS unit, the time synchronizing unit 420 can synchronize the system times on the basis of a GPS signal received from satellites by the GPS unit so as to remove tire time errors between the reference traffic light and the other control target traffic lights belonging to the same reference traffic light sharing group.

Alternatively, when the broadcast signal analyzing unit 410 extracts the time data as the broadcast signal analysis result, the time synchronizing unit 420 can reset the previous system time and set the current system time to the time corresponding to the time data so as to remove the time errors between the reference traffic light and the other control target traffic lights belonging to the same reference traffic tight sharing group.

The offset setting unit 430 sets the offset times of the control target traffic lights using the offset parameter extracted by the broadcast signal analyzing unit 410.

When the extracted offset parameter is data on the traveling speed on the road the offset setting unit 430 reads the previously-stored distances between the reference traffic light and the control target traffic lights from a memory (not illustrated), applies the traveling speed and the distances to a predetermined algorithm, and sets the calculated values as the offset times of the control target traffic lights. For example, a ratio of the distance and the traveling speed may be set as the offset time. As described above, the traveling speed may be a value in which one or more road information pieces of the current traveling speed of a vehicle traveling on the road, the number of lanes of the road, the gradient, the curvature, presence of a speed bump, a state of the road surface, the weather, the vehicle traffic, the queue, and the time zone are reflected.

When the extracted offset, parameter is data in which plural offset times are sequentially arranged in a predetermined order, the offset setting unit 430 may extract the offset time corresponding to the order of the corresponding control target traffic light, on the basis of a predetermined order of the control target, traffic lights in the reference traffic light sharing group and may set the extracted offset time as the offset time of the control target traffic light in this case, information on the distances between the reference traffic light and all the control target traffic lights belonging to the same reference traffic light sharing group is stored in the traffic control center 100, and values obtained by dividing the distances by the traveling speed reflecting the currently-collected road information are calculated as the offset, times of the control target traffic lights in advance, may be included in the broadcast signal, and may be broadcast.

The signal light change control unit 440 sets the signal light display start time point of the control target, traffic light to the time point which lags by the offset time set by the offset setting unit 430 from the reference start time of the reference traffic light based on the system time set by the time synchronizing unit 420, and outputs to the control target traffic light a control signal for causing the control target traffic light, to periodically change the signal light, that is, to start the main display, at the set signal light display start time point.

When the offset time set by the offset setting unit 430 has a negative value, it means that the control target traffic light is installed prior to the reference traffic light. In this case, the time point which leads by the time corresponding to the absolute value of the offset time from the reference tart time is set as the signal light display start time of the control target traffic light.

When the broadcast signal is the signal light change control information as the analysis result in the broadcast signal analyzing unit 410, the signal light change control unit 440 extracts and compares the controller identifier, and extracts tire start time data, the traffic light number data, the signal light order date, and the signal light cycle date and updates the display table of the control target traffic light when tire extracted controller identifier corresponds to tire traffic light controller. That is, the signal light change control unit can output to the control target traffic light a control signal for causing the traffic light (traffic light for vehicles and/or pedestrians) corresponding to the traffic light number data out of the control target traffic lights to change the signal light repeatedly with a signal light cycle corresponding to the signal light cycle data at the time point corresponding to the start time data in tire signal light change order based on the signal light order data.

When existing signal light display is periodically carried out and should be changed to new signal light display by receiving the broadcast signal, the signal light change control unit 440 calculates a time difference between the existing signal light display and the new signal light display, calculates the number of display occurrence in the time difference, and synchronizes the time so that the new signal light display is started at a desired time point by increasing or decreasing the display time. In this case, only a specific display time may be changed or the entire display time may be increased or decreased at a uniform rate.

In another embodiment, the traffic light control unit 220 may further include an error checking unit 450. The error checking unit 450 stores error information such as a traffic light error, a GPS error, and a broadcast signal reception error as history data and transmits the history data to the traffic control center 100 immediately or in accordance with a constant schedule on the basis of a predetermined criterion (for example, seriousness of the error) The transmission of the history data from the error checking unit 450 can be carried out via a interactive communication unit 230 to be described later.

Examples of the traffic light error include a case where failure such as short-circuit or disconnection due to current flowing in the circuits is detected when the traffic light is turned on or turned off. Examples of the GPS error include a case where the GPS data is not received or the GPS time is not changed at the time of checking the GPS signal or a case where the GPS time is not changed or the GPS data is not received even in a predetermined time after the GPS unit is reset Examples of the broadcast signal reception error include a case where a broadcast signal is not received, or a received data packet includes an error, counter data for checking an error included in the data is not updated for a predetermined time, or the counter value is not increased.

The type (for example, one or more of the traffic light, the GPS unit, and the broadcast signal receiving unit) of a module having an error, the error occurrence time, and the number of error occurrence along with the identifier of the traffic light controller having an error may be included in the history data and may be transmitted together.

The traffic light controller 200 may further include a signal light-interlocked speed output unit 460. The signal light-interlocked speed output unit 460 outputs traveling speed information included in the offset parameter extracted as the analysis result of the broadcast signal or information on the traveling speed inversely calculated from the offset time included in the offset parameter using the distance between the reference traffic light and the control target raffle light in the form of characters, signs, voice, or graphics so as that the driver on the road can confirm the information. For example, an LCD or LED display unit, may be disposed around the traffic light and the signal light-interlocked speed may be displayed in the form of characters, signs, or graphics, or a speaker may be disposed around the traffic light and the signal light-Interlocked speed may be output as voice information.

The signal light-interlocked speed output, unit. 460 may transmit the signal light-interlocked speed information by communicating with a communication terminal (for example, a navigation terminal) mounted on a vehicle traveling on the road in a short-range radio communication manner, and may cause the driver to confirm the corresponding information through tire use of an output module (such as a display unit or a speaker) disposed in the communication terminal inside the vehicle.

In the present invention, the signal light-interlocked speed for making a traffic flow on the road smooth is assumed and the traffic lights sequentially change the signal light thereof. Therefore, when a driver traveling on the road is provided with the signal light-interlocked speed interlocking with the current signal light change, an overspeed can be prevented to achieve safe driving and the driver does not wait, at the traffic lights, which Is helpful to economical driving.

Alternatively, since information on the signal light-interlocked speed is registered in the traffic control center 100, information on the signal light-interlocked speed on the road corresponding to the vehicle position information may be broadcast from, the traffic control center 100 to the corresponding vehicle via a broadcast network.

The communication terminal (for example, a navigation terminal) mounted on a vehicle extracts the information on the signal light-interlocked speed Included in the received broadcast signal, converts the extracted information into the form which can be confirmed by the driver, and outputs the resultant information. For example, the information may be displayed in the form of characters or numerals in a partial area of a screen display unit or may be output in the form of voice from the speaker.

The signal light-interlocked speed may be used as information for a anise function of enabling constant-speed traveling without stepping the vehicle accelerator by interlocking with a device (for example, an ECU) of the vehicle.

Referring to FIG. 2 again, the traffic light controller 200 according to another embodiment may further include an Interactive communication unit 230 that transmits the error information generated from the error checking unit 450, that Is, information indicating the internal abnormal state of the controller and/or the abnormal state of the traffic light to the traffic control center 100.

The interactive communication unit 230 may use a wired or wireless network and may be a communication module that can transmit and receive data via the third-generation, fourth-generation, or next-generation mobile communication network such as CDMA, WCDMA, GSM, and LTE or that can transmit and receive data via a short-range radio communication network such as WIFI When the traffic control center 100 requests the traffic fight controller 200 for interactive communication, the interactive communication unit 230 can perform interactive communication with the traffic control center 100 so as to exchange data and programs or the like.

In an existing Internet network using fixed IP addresses, the traffic light controller can respond to a request from the traffic control center 100, but cannot transmit a response without any request. However, in the present invention, when the traffic control center 100 requests communication with a traffic light controller 200 having a specific ID via a broadcast network; the traffic tight controller 200 having the ID can be provided with a variable IP address through the use of the interactive communication unit 230 and car access the traffic control center 100.

In the traffic light controller 200 according to the present invention, a display table for signal light change may be basically stored in a memory thereof. One or more display tables may be provided, may vary depending on conditions such as weather, rush hour, time zone, weekday, holiday, and night, may be combined for use. Even when the type and order of signal light display is the same, the holding time of signal light display may be changed depending on tire conditions. The display table may include such a form that the traffic lights in all directions or the traffic lights in some directions flicker when an accident occurs on the road or the road is closed. Alternatively, when the broadcast signal is not received for a predetermined time due to occurrence of disaster; the disaster state may be checked and Redetermined signal light display such as flickering of yellow light may occur.

The display table may be updated such as being edited, deleted, or added. The update of the display table may be carried out on the basis of the signal light change control information when the signal light change control information is included in the broadcast signal as the analysis result of the broadcast signal FIG. 5 is a flowchart illustrating a traffic light control method according to an embodiment of the present invention.

Figure 5:
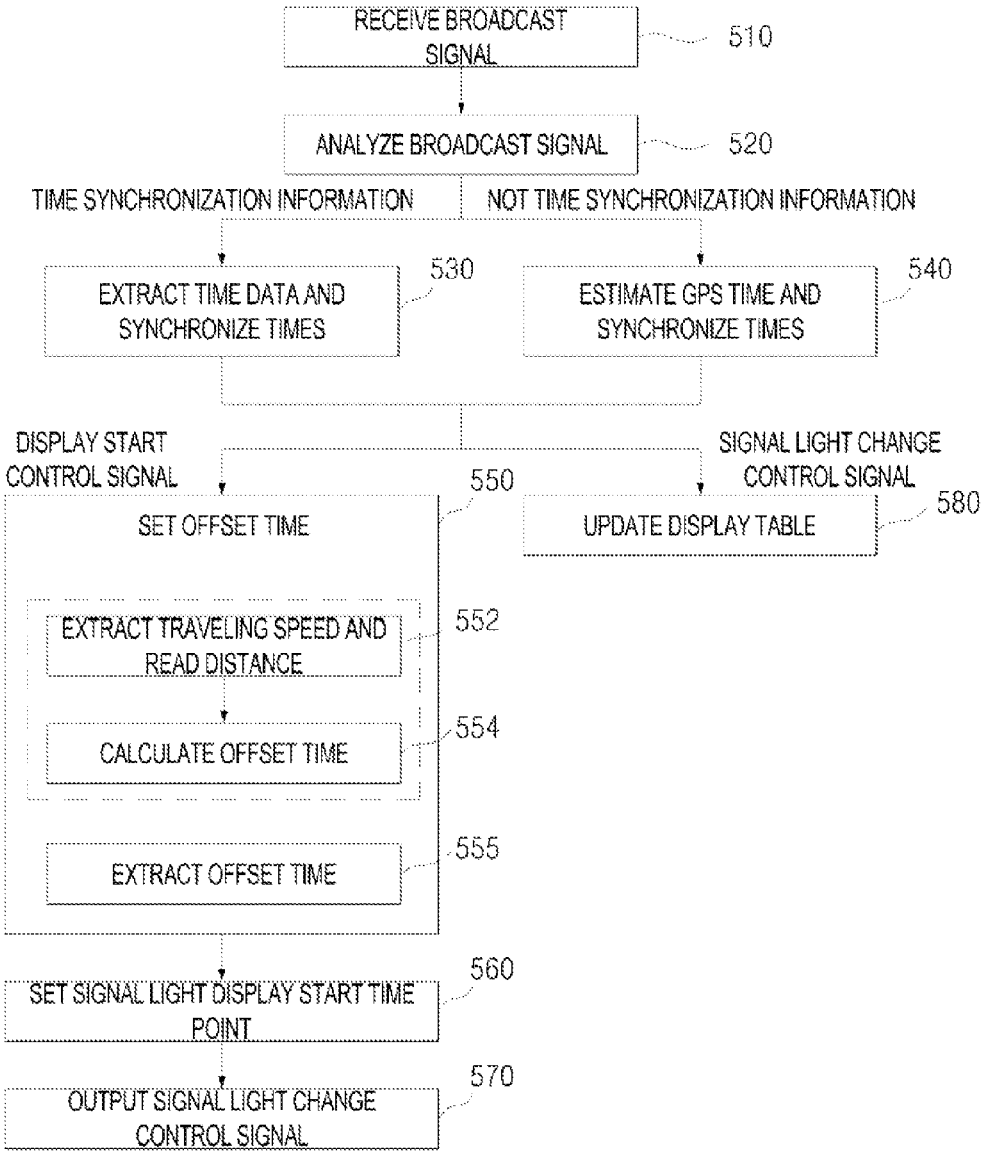
FIG. 5 is a flowchart illustrating a traffic light, control, method according to an embodiment of the present invention.

Tire process flow illustrated in FIG. 5 is performed by the constituent units of the traffic light controller and is based on the method of controlling signal light change of a control target traffic light when a broadcast signal is received via a broadcast network.

Referring to FIG. 5, the broadcast signal receiving unit 210 receives a broadcast signal emitted from tire traffic control center 100 via the broadcast, network in step 510. The broadcast signal may be received via a broadcast, channel such as FM, AM, or DMB.

In step 520, the broadcast, signal analyzing unit 410 analyzes the broadcast signal received by the broadcast signal receiving unit 210. The broadcast signal includes distinction data as illustrated in FIGS. 3*a*, 3*b*, and 3*c*, and can be determined to be which of display start control information, signal light change control information, and time synchronization information depending on the extraction and analysis result of the distinction data.

The process of analyzing the broadcast signal includes a process of extracting data (such as a group identifier, reference start time data, offset parameter, start time data, traffic light number data, signal light order data, signal light cycle data, and time data) other than the distinction data included in the broadcast signal.

When the broadcast signal is the time synchronization information as the analysis result in the broadcast signal analyzing unit 410, the time synchronization, unit 420 synchronizes the system time of the traffic light, controller 200 with the system times of the reference traffic light and other traffic fight controllers using the time data extracted from the broadcast signal in step 530.

When the broadcast signal is not the time synchronization information as the analysis result in the broadcast signal analyzing unit 410, the time synchronization unit 420 estimates the GPS time using the GPS unit separately included in the traffic light controller 200 and synchronizes the system time of the traffic light controller with the estimated GPS time to synchronize the reference traffic light with the other traffic light controllers in step 540.

When the time synchronization is completed and the broadcast signal is the display start control information, the offset setting unit 430 sets the offset times of the control target traffic lights using the offset parameter extracted by the broadcast signal analyzing unit 410 in step 550.

When the extracted offset parameter is data on the traveling speed on the road, the offset setting unit 430 reads the distances between the reference traffic light and the control target traffic lights stored in advance in step 552, and applies the traveling speed and the distances to a predetermined algorithm to calculate the offset times of the control target traffic lights in step 554.

When the extracted offset parameter is data in which plural offset times are sequentially arranged in a predetermined order, the offset setting unit 430 extracts the offset timed corresponding to a predetermined order of the control target traffic signals in the reference traffic light sharing group and sets the extracted offset times as the offset times of the control target, traffic lights in step 556.

When the setting of the offset, times is completed, the signal light change control unit 440 sets the signal tight display start time points of the control target traffic lights to the time points which lag by the offset times from the reference start time of the reference traffic light based on the system time set by the time synchronization unit 420 in step 560.

In step 570, the signal light change control unit 440 outputs a control signal for causing the control target traffic lights to start main display of signal light at the newly-set signal light display start time point to the control target traffic lights. Here, the main display may be display of signal light (for example, green light) which causes vehicles traveling in a predetermined direction to go ahead.

When the broadcast signal is the signal light change control information, the signal light change control unit 440 extracts the start time data, the traffic light, number data, the signal light order data, and the signal light cycle data for the corresponding controller identifier and updates the display table of the control target, traffic lights.

The above-mentioned traffic light control method may be embodied as automated procedures based on the time-series order by a program built or installed in a digital processor. Codes and code segments of the program will be easily inferred by computer programmers skilled in the art. The program can be stored in a computer-readable recording medium and can be read and executed by a digital processor to embody the above-mentioned method. Tire recording medium includes a magnetic recording medium, an optical recording medium, and a carrier wave medium.

In general, since a public network, is not installed in out-of-town regions of the provinces, network installation work is necessary for connecting the traffic control center to the traffic signal controllers and much cost is consumed in the work.

However, in the present invention, since a broadcast signal Is transmitted via foe broadcast network to connect the traffic control center to the traffic light controllers in a wireless manner, it is possible to save the above-mentioned cost.

The concept of a virtual traffic light is introduced into the present invention. Accordingly, an ID of a traffic light controller can be allocated to a location in which a traffic light is not actually installed and the signal light, change cycle of the virtual traffic light can be transmitted by broadcasting.

In this case, a vehicle traveling around the location can receive the broadcast signal through the use of a navigation terminal or the like, can understand signal light of the traffic lights in the traveling direction, and can use tire virtual traffic lights as the actual traffic lights at the time of guiding a path. The signal light may be displayed on a display unit or output as an audio via a speaker so as to enable a user to recognize the signal light.

A device receiving the broadcast signal like a navigation terminal installed in a vehicle can display signal light change cycles and states of the traffic lights at crossroads and can visually or auditorily inform the next time of change to signal, light indicating that a vehicle can go ahead. Alternatively, the device can perform an operation of stopping an engine in a waiting state and automatically starting up when the signal light indicating that a vehicle can go ahead appears in the next time. The broadcast signal can be used as a signal for controlling the operation of an engine in economical driving. That is, such a signal may be used to notify the remaining time up to the next signal light for going ahead or the next signal light cycle or the entire order, or may be used as a vehicle control signal for stopping or slowing down the vehicle when the signal light received from the traffic light installed in the traveling direction is red.

Those skilled in the art will understand that the invention can be modified in various specific forms without changing the technical concept or essential features of the invention. Accordingly, it should be understood that the above-mentioned embodiments are not definitive but exemplary in all the points of view. The scope of the invention is defined by the appended claims, not by the above-mentioned detailed description, and it should be understood that all modifications and changes derived from the scope of the claims and equivalents thereof belong to the scope of the invention.

The invention claimed is:

1. A traffic light control device that controls signal light change of a traffic light, comprising:

a broadcast signal receiving unit that receives a broadcast signal emitted from a traffic control center via a broadcast network; and a traffic light control unit that determines an offset time from a reference traffic light on the basis of offset parameter of the broadcast signal when the traffic light is a control target traffic light belonging to a reference traffic light sharing group indicated by the broadcast signal and that outputs a control signal for controlling the light change of the control target traffic light so that a time point which is adjusted by the determined offset time from a signal light display start time point of the reference traffic light is matched with a signal light display start time point of the control target traffic light.

2. The traffic light control device according to claim 1, wherein the traffic light control unit includes:

a broadcast signal analyzing unit that analyzes the broadcast signal;

a time synchronization unit that synchronizes a system time of the control target traffic light with a system time of the reference traffic light using time-synchronization time data extracted from the broadcast signal or a GPS time estimated through the use of a GPS unit;

an offset setting unit that sets the offset time using an offset parameter extracted from the broadcast signal; and a signal light change control unit that outputs a control signal for starting signal light display of the control target traffic light at a time point which is adjusted by the offset time from the signal light display start time point of the reference traffic light.

3. The traffic light control device according to claim 2, wherein the offset parameter is a traveling speed of vehicles in a road in which the control target traffic light is installed, and wherein the offset setting unit sets the offset time on the basis of a correlation of a distance between the reference traffic light and the control target traffic light with the traveling speed of vehicles, which is stored in the traffic signal control unit.

4. The traffic light control device according to claim 2, wherein the control target traffic light along with other control target traffic lights installed in a road having the control target traffic light installed therein is grouped into a reference traffic light sharing group and the control target traffic lights share one of traffic lights really installed at any position of the road or virtually installed as the reference traffic light, wherein the offset parameter is data in which offset times of all the control target traffic lights belonging to the reference traffic light sharing group are arranged in a predetermined order, and wherein the offset setting unit extracts the offset times of the order corresponding to the control target traffic lights and sets the extracted offset times as the offset times of the corresponding control target traffic lights.

5. The traffic light control device according to claim 2, wherein the offset time is determined on the basis of a correlation between a distance between the reference traffic light and the control target traffic light and a traveling speed of a vehicle in a road in which the control target traffic light is installed.

6. The traffic light control device according to claim 3, wherein one or more of the distance and the traveling speed is a value in which road information including one or more of the number of lanes, gradient, curvature, presence of a speed bump, a state of a road surface, weather, vehicle traffic, queue, and time zone is reflected.

7. The traffic light control device according to claim 1, wherein the broadcast signal is broadcast from the traffic control center via one of an FM broadcast channel, an AM broadcast channel, and a DMB broadcast channel.

8. The traffic light control device according to claim 1, wherein the signal light display start time point is a time point at which the reference traffic light and the control target traffic light start mainly displaying signal light indicating traveling of vehicles.

9. A traffic light control method which is performed by a traffic light control device controlling signal light change of a traffic light, the traffic light control method comprising the steps of:

receiving unit a broadcast signal emitted from a traffic control center via a broadcast network;

analyzing the broadcast signal;

determining an offset time from a reference traffic light on the basis of offset parameter of the broadcast signal when the traffic light belongs to a reference traffic light sharing group identified by the broadcast signal; and outputting a control signal for controlling the light change of a control target traffic light so that a time point which is adjusted by the determined offset time from a signal light display start time point of the reference traffic light is matched with a signal light display start time point of the control target traffic light.

10. The traffic light control method according to claim 9, wherein a step of synchronizing a system time of the control target traffic light with a system time of the reference traffic light using time-synchronization time data extracted from the broadcast signal or a GPS time estimated through the use of a GPS unit is performed before the step of determining the offset time.

11. The traffic light control method according to claim 9, wherein the offset parameter is a traveling speed of a vehicle in a road in which the control target traffic light is installed, and wherein the offset time is set on the basis of a correlation of a distance between the reference traffic light and the control target traffic light with the traveling speed that are stored.

12. The traffic light control method according to claim 9, wherein the step of determining the offset time includes setting the offset time using an offset parameter extracted from the broadcast signal, wherein the control target traffic light along with other control target traffic lights installed in a road having the control target traffic light installed therein is grouped into a reference traffic light sharing group and the control target traffic lights share one of traffic lights really installed at any position of the road or virtually installed as the reference traffic light, wherein the offset parameter is data in which offset times of all the control target traffic lights belonging to the reference traffic light sharing group are arranged in a predetermined order, and wherein the offset times of the order corresponding to the control target traffic lights are extracted and are set as the extracted offset times as the offset times of the corresponding control target traffic lights.

13. The traffic light control method according to claim 9, wherein the offset time is determined on the basis of a correlation between a distance between the reference traffic light and the control target traffic light and a traveling speed of a vehicle in a road in which the control target traffic light is installed.

14. The traffic light control method according to claim 11, wherein one or more of the distance and the traveling speed is a value in which road information including one or more of the number of lanes, gradient, curvature, presence of a speed bump, a state of a road surface, weather, vehicle traffic, queue, and time zone is reflected.

15. The traffic light control method according to claim 9, wherein the broadcast signal is broadcast from the traffic control center via one of an FM broadcast channel, an AM broadcast channel, and a DMB broadcast channel.

16. The traffic light control method according to claim 9, wherein the signal light display start time point is a time point at which the reference traffic light and the control target traffic light start mainly displaying signal light indicating traveling of vehicles.

* * * * *